United States Patent [19]

Suzuki

[11] 4,285,297

[45] Aug. 25, 1981

[54] MAGNETIC BRUSH DEVELOPING DEVICES

[75] Inventor: Yoshiro Suzuki, Hachioji, Japan

[73] Assignee: Olympus Optical Company Limited, Tokyo, Japan

[21] Appl. No.: 99,191

[22] Filed: Nov. 29, 1979

[30] Foreign Application Priority Data

Dec. 2, 1978 [JP] Japan ..... 53-166452[U]

[51] Int. Cl.[3] ..... G03G 15/09

[52] U.S. Cl. ..... 118/657; 118/658

[58] Field of Search ..... 118/655-658

*Primary Examiner*—Bernard D. Pianalto

*Attorney, Agent, or Firm*—Haseltine & Lake

[57] ABSTRACT

A magnetic brush developing device for developing an electrostatic charge image comprises a hopper for containing toners to be supplemented, a toner supplying roller rotatably mounted in a lower opening of the hopper and provided at its periphery with a longitudinal recess for receiving therein a given amount of toners from the hopper and means for limiting a length of the opening, through which toners are supplemented, along an axis of the roller, so as to make the length of the opening smaller than a maximum width of an electrostatic charge image to be developed by the developing device.

4 Claims, 8 Drawing Figures

MAGNETIC BRUSH DEVELOPING DEVICES

BACKGROUND OF THE INVENTION

1. Field of the Invention

The present invention relates to a magnetic brush developing device for developing an electrostatic charge image and used for an electrophotographic apparatus such as copying machine, printing machine and the like, and more particularly to a toner supplementing device for supplementing toners to a developing agent contained in a housing of a magnetic brush developing device.

2. Description of the Prior Art

In the magnetic brush developing device, use is generally made of a two component developing agent consisting of carriers made of magnetic material and toners made of thermoplastic resin of low melting point and mixed with dye or pigment such as carbon black. Such a two component developing agent is stirred and mixed in the developing device and the toners are charged due to friction between the toners and carriers to a polarity opposite to that of an electrostatic charge image on a charge retentive member such as a photosensitive drum.

In such a developing device, since the toners are consumed each time the developing operation is effected, the developing device is provided with a hopper for containing toners and a device for supplementing a given amount of toners from the hopper so as to keep always a toner concentration of the developing agent to a desired value.

Various kinds of toner supplementing devices have heretofore been proposed. In one conventional toner supplementing device, provision is made of a hopper containing toners to be supplemented to a housing of a developing device and provided at its lower opening with a toner supplying roller having a longitudinal recess for receiving a given amount of toners from the hopper, the roller rotating intermittently in response to consumption of toners contained in the housing of the developing device so as to drop off the toners in the longitudinal recess into the housing and supplement the toners. However, such conventional device could not supplement toners in a stable state, since toners have not always a good fludity. As a result, the longitudinal recess of the toner supplying roller is stuffed with toner particles or the toner particles tend to bridge the surface of the roller. In order to avoid such defects, in another conventional toner supplementing device, the above mentioned hopper is provided at its lower opening with a resilient plate having one end operative to engage with the toner supplying roller and vibrate in response to the rotation of the roller so as to make toners flow down therethrough. In such a device, toners fall down through a slit-like space formed between side edges of the resilient plate and inner side walls of the housing of the developing device. This results in not uniform distribution of toners along the entire width of an electrostatic charge image to be formed on a charge retentive member and may cause a photographic fog at a peripheral portion of a picture.

In order to eliminate the above mentioned drawbacks of the conventional devices, an improved toner supplementing device which can obtain a picture having a better quality has heretofore been sought for.

SUMMARY OF THE INVENTION

The present invention has its object to provide a magnetic brush developing device comprising a toner supplementing device which can eliminate the above described defects, which can supply toners to an electrostatic charge image in a uniform manner along its entire width and which is simple in construction.

It is another object of the invention to provide a toner supplementing device for a copying machine, which can obtain an electrophotographic copy having a well-balanced density.

A feature of the invention is the provision of a magnetic brush developing device comprising a housing for containing a developing agent, a magnetic brush assembly including a tubular sleeve made of non-magnetic material and a permanent magnet assembly arranged inside said sleeve, a hopper for containing toners and provided at its lower end with an opening through which the toners are supplemented to said developing agent, a toner supplying roller rotatably journaled in said lower opening of said hopper and having a longitudinal recess for receiving a given amount of toners from said hopper, a resilient plate having one end secured to an inner wall of said hopper, the other free end being operative to engage with said longitudinal recess of said roller, and means for limiting a length of said opening along an axis of said roller such that said length of said opening is smaller than a maximum width of an electrostatic charge image to be developed by said developing device.

BRIEF DESCRIPTION OF THE DRAWINGS

The present invention will be described more in detail with reference to the accompanying drawings, in which.

DETAILED DESCRIPTION OF THE PREFERRED EMBODIMENTS

Figure 1A:
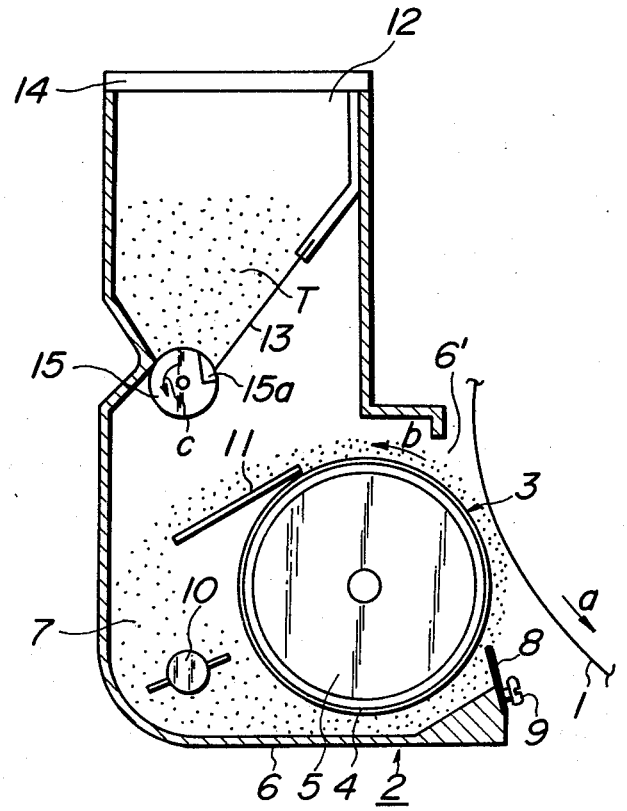
FIG. 1A PRIOR ART
FIG. 1A is a sectional view of a conventional magnetic brush developing device comprising a toner supplementing device.

FIG. 1A is a cross section for showing a conventional magnetic brush developing device for an electrographic copying machine which makes use of a conventional toner supplementing device. It is apparent that the electrophotographic printing machine may use similar magnetic brush developing devices. An electrostatic charge retentive member 1 is composed of a drum having a surface layer made of insulating material or photoconductive material and is rotatably journaled in a main body of the copying machine (not shown) so as to be rotated in a direction shown by an arrow a. By means of a known electrophotography an electrostatic charge image may be formed on the surface layer of the drum 1.

A developing device generally denoted by a reference numeral 2 is removably mounted in the main body of the copying machine and comprises a magnetic brush assembly 3 including a tubular sleeve 4 made of non-magnetic material and a permanent magnet assembly 5 arranged inside the sleeve. The magnet assembly 5 as well as the sleeve 4 are rotatably mounted in a housing 6 of the developing device. The magnetic brush assembly 3 is arranged in the housing 6 at a position near its opening 6' so that a part of the sleeve 4 is exposed to the outside of the housing 6 through the opening 6'. During the developing operation the sleeve 4 is rotated in a direction shown by an arrow b by means of a suitable driving mechanism not shown, but the magnet assembly 5 is fixed at a given rotational position, i.e., at a position in which at least one of the poles of the magnet assembly 5 is opposed to the charge retentive member 1. A developing agent 7 consisting of magnetic carriers and toners is stored in the housing 6 and is attracted onto the surface of the sleeve 4 due to a magnetic force of the magnet assembly 5 so as to form a so-called magnetic brush. Under such a condition when the sleeve 4 is rotated in the direction b, the developing agent 7 is fed along the sleeve surface to the surface of charge retentive member 1 and made contact therewith. In this way, the electrostatic charge image on the drum 1 is developed with toners. A doctor blade 8 for limiting an amount of agent 7 fed onto the sleeve 4, i.e., for limiting a height of furs of magnetic brush is secured to a lower edge of the opening 6' of the housing 6 by screw 9. Near the bottom of the housing 6 is also rotatably arranged an agitating vane 10 for stirring the agent 7 so as to charge the toners by friction to a given polarity.

The developing agent still remained on the sleeve surface after one developing operation has been completed is scraped off the sleeve 4 by means of a scraping blade 11. The developing agent scraped off the sleeve 4 is agitated at the bottom of the housing 6 and is attracted again to the sleeve surface so as to be used again at a new developing operation.

At an upper portion of the housing 6 is arranged a toner supplementing device comprising a hopper 12 for containing toners T to be supplemented to the developing agent 7. The hopper 12 is formed by a part of the housing 6 and a resilient plate 13. An upper opening of the hopper 12 is closed by a lid 14. At a lower opening of the hopper 12 is arranged a toner supplying roller 15 which is rotated at a given speed in a direction shown by an arrow c in synchronism with the rotation of the sleeve 4. The roller 15 is provided at its periphery with a longitudinal recess **15*a* for receiving therein a given amount of toners T in the hopper 12. During the operation a front edge of the resilient plate 13 engages with the recess 15*a*. In this case, any residual toners in the recess 15*a* can be positively taken out of it by means of the front edge of resilient plate 13. Since the toners are fine powders, a bridge of toners tends to be formed above the roller 15. In this example, the resilient plate 13 vibrates each time its front edge engages with the recess 15*a* of the roller 15** and thus said bridge is broken and the toner particles can be supplemented in a very stable and accurate manner.

However, the conventional device shown in FIG. 1 has the following defects. As shown in FIG. 2, which is a partial plan view of the device shown in FIG. 1A, between the resilient plate 13 and inner sidewalls 16 of the housing 6 is formed a narrow slit-like space 17 in order to allow the resilient plate 13 to move smoothly. In practice, however, toner particles have a small diameter of approximately 10 μm so that it is difficult to make the space 17 narrower than the diameter of the toner particle by a mechanical means. Therefore, in practice, toners are made undesirably free to drop down through the space 17 so that the toners cannot be supplemented uniformly. Although the toners dropped through the space 17 are in part stirred by the agitating vane 10, it is very difficult to distribute the toners uniformly in a short time in a direction along the longitudinal axis of the toner supplying roller 15. An existing mechanism for effecting such uniform distribution is highly expensive and hence is not suitable for use in practice. As a result, a concentration of the toner in the developing agent is high at the two side parts of the longitudinal axis of the toner supplying roller 15 and is low at the center part thereof so that a photographic fog tends to occur at a peripheral portion of a copy and that a developing density becomes not uniform. Moreover, since peripheral parts of an original copy are mainly blank and most of toners are consumed at the center part thereof, it is desirable to supply a smaller amount of toner to the two sides of the longitudinal axis of the toner supplying roller 15 and a slightly larger amount of toner to the center part thereof. This means that dropping of the toners through the space 17 affects an adverse effect upon a picture quality of a copy.

In order to avoid such defects, in a magnetic brush developing device comprising a toner supplementing device according to the invention, a length of an opening formed along a longitudinal axis of a toner supplying roller and usable for supplying the toner is made smaller than a maximum width of electrostatic charge image to be developed.

Figure 1B:
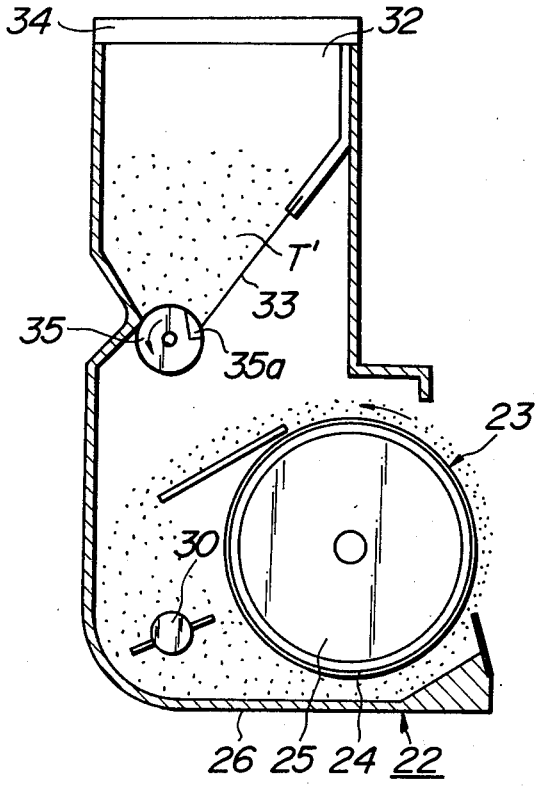
FIG. 1B is a sectional view of a magnetic brush developing device according to the present invention.
Figure 2:
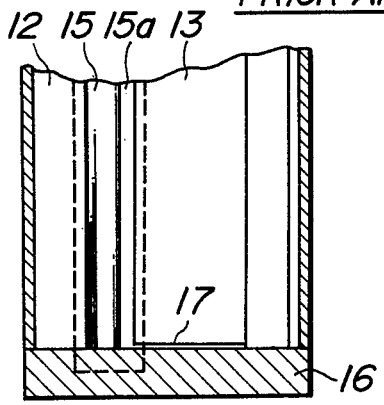
FIG. 2 PRIOR ART
FIG. 2 is a plan view of essential parts of the toner supplementing device shown in FIG. 1A.

FIG. 1B shows a sectional view of a magnetic brush developing device according to the invention which makes use of a toner supplementing device constructed as above described.

Various parts shown in FIG. 1B correspond to those shown in FIG. 1A, so that any detailed description thereof is omitted. In FIG. 1B, reference numeral 22 designates a magnetic brush developing device in general, 24 a sleeve, 25 a permanent magnet assembly, 30 an agitating vane, 32 a hopper, 33 a resilient plate, 34 a lid, 35 a toner supplying roller, **35*a* its longitudinal recess and T' toners contained in the hopper 32**.

Figure 3:
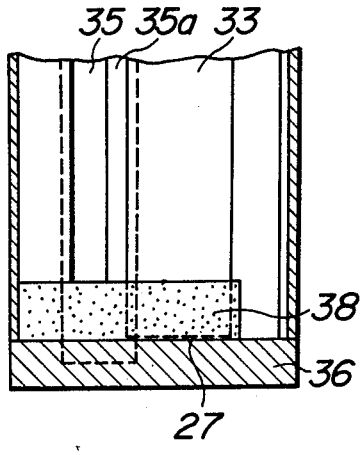
FIG. 3 is a plan view of an embodiment of a toner supplementing device according to the present invention.

FIG. 3 is a plan view of essential parts of an embodiment of a toner supplementing device according to the present invention. In the device shown in FIG. 3, provision is made of a stopper 38 so as to close a narrow slit-like space 37 formed between end edges of a resilient plate 33 and inner sidewalls 36 of a housing 26. The stopper 38 is secured to both end edges of the resilient plate 33 and serves to prevent the toners from dropping down through the space 27.

Figure 4:
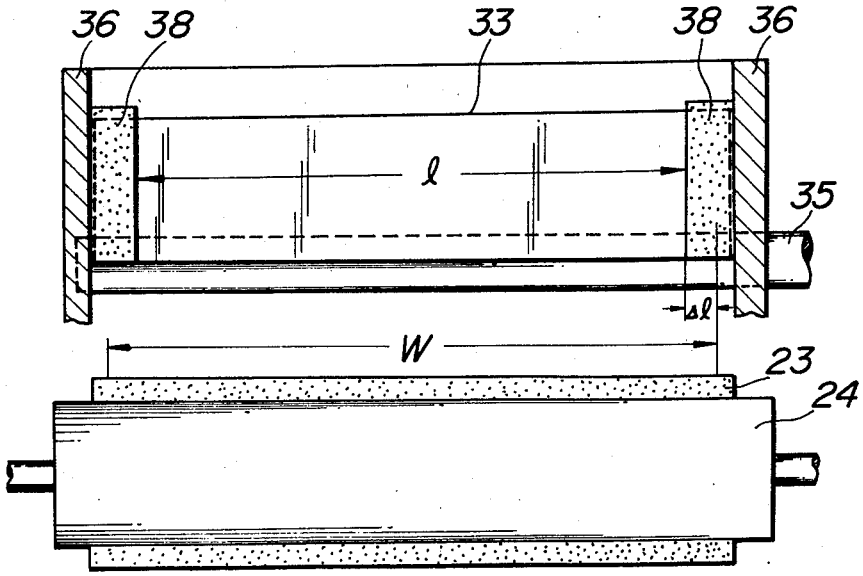
FIG. 4 is a plan view of the toner supplementing device shown in FIG. 3 for explaining a relationship between a length l of a toner supplying opening and a maximum width w of a charge image to be developed.
Figure 5A:
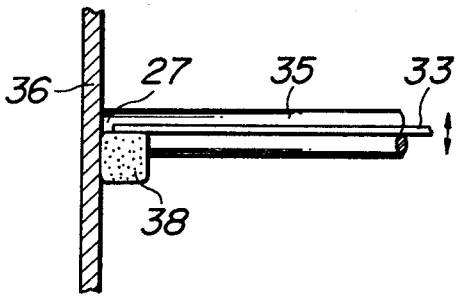
FIGS. 5A and 5B are schematic diagrams for showing two modes of securing a stopper to an inner sidewall of a housing of a developing device.
Figure 5B:
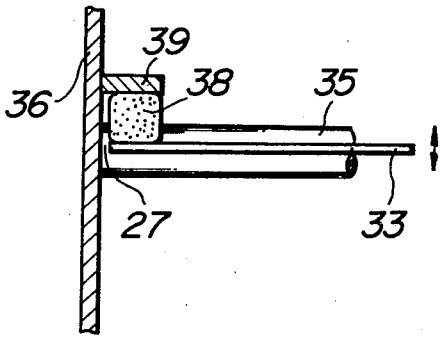

As shown in FIG. 4, the stoppers 38 serve to make a length l of an opening through which the toners are supplemented smaller than a maximum width w of an electrostatic charge image to be developed by a magnetic brush 23 formed around the sleeve 24 of the magnetic brush developing device 22. The stopper 38 is made of a resilient material such as sponge, rubber, polyurethane and polyethylene. The stopper 38 is secured to both side edges of the resilient plate 33 so as to closely make contact with both the inner sidewalls 36 of the housing 26 and the toner supplying roller 35 as shown in FIG. 5A. Alternatively, as shown in FIG. 5B, the sidewall 36 may be provided with a rib 39 and the stopper 38 may be sandwiched between this rib 39 and the lower end of the resilient plate 33 so as to closely make contact with the toner supplying roller 35. The resilient stopper 38 can prevent the undesirable fall of toners through the space 27 without giving any hindrance to movement of the resilient plate 33.

As described above, the length l of the lower opening of the hopper 32 for supplementing toners is made smaller than the maximum width w of the electrostatic charge image to be developed by the developing device 22, so that it is possible to properly correct a difference of consumption of the toners between the central part and end part of the image to be developed. That is, a small but sufficient amount of toners is supplied to the end part of the image to be developed by the agitation effect of the agitating vane 30, such small amount of the toners being well-balanced with larger amount of toners supplied to the center part of the image to be developed since peripheral parts of a copy is almost blank. A difference $\Delta l$ between the width w and the length l is preferably made from 5 mm to 15 mm in general. The value of the difference $\Delta l$ may of course be varied by a degree of agitation by the agitating vane 30.

Figure 6:
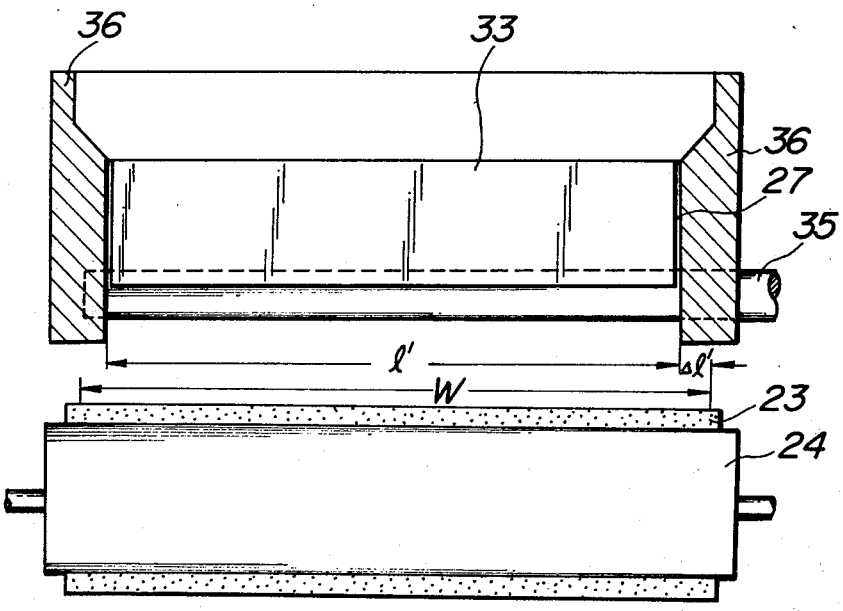
FIG. 6 is a plan view of another embodiment of a toner supplementing device according to the invention which does not make use of any stoppers.

FIG. 6 shows schematically another embodiment of a magnetic brush developing device according to the present invention. In this embodiment, any stopper described with reference to the previous embodiment is not used for limiting the length l′ of the opening through which toners are supplemented to a developing agent, but toners are supplemented to the developing agent through a simple construction so as to distribute the toner uniformly. In the present embodiment, the inner sidewalls 36 are inwardly projected so as to make the length l′ of the opening through which toners are supplemented narrower so that the space through which toners drop down approaches to the central part of the axis of the toner supplying roller 35, that is, the axis of the sleeve 24. The present embodiment constructed as above described is capable of well balancing the toners supplied to an end part of the sleeve 24 with the amount of the toners consumed thereat. It is a matter of course that the length l′ is smaller than the length l of the previous embodiment shown in FIG. 4 so that a difference $\Delta l'$ between the width w and the length l′ shown in FIG. 6 is larger than the difference $\Delta l$ shown in FIG. 6. The difference $\Delta l'$ is preferably from 10 mm to 25 mm. Other reference numerals shown in FIG. 6 and corresponding to those shown in FIGS. 3 and 4 denote the same parts as those shown in FIGS. 3 and 4.

As above described, a magnetic brush developing apparatus according to the present invention comprising a toner supplementing device constructed as above described is simple in construction and can supplement toners and distribute these toners uniformly along the entire width of an electrostatic charge image. This is because of the fact that a length of an opening through which toners are supplemented is made smaller than a width of an electrostatic charge image to be developed. Therefore, a copying machine comprising a magnetic brush developing device according to the present invention can obtain a copy without deteriorated by a photographic fog. This construction can be realized, for example, by providing stoppers in the device shown in FIGS. 3 and 4.

The invention is not limited to the above described embodiments and various alternations and modifications are possible. For example, the toner supplementing device united with the magnetic brush developing device as above described may be separated from the latter.

What is claimed is:

1. An improved magnetic brush developing device comprising: a housing for containing a developing agent, a magnetic brush assembly including a tubular sleeve made of non-magnetic material and a permanent magnet assembly arranged inside said sleeve, a hopper for containing toners and provided at its lower end with an opening through which the toners are supplemented to said developing agent, a toner supplying roller rotatably journalled in said lower opening of said hopper and having a longitudinal recess for receiving a given amount of toners from said hopper, and a resilient plate having one end secured to an inner wall of said hopper, the other free end being operative to engage with said longitudinal recess of said roller, the improvement comprising: a stopper engagable with two side edges of said resilient plate and with the inner sidewalls of said housing and extending in a direction perpendicular to the axial direction of said toner supplying roller, whereby, a length of said toner supply opening of said hopper is smaller than a maximum width of an electrostatic charge image to be developed by said developing device, and said stopper being deformable in response to the displacement of said resilient plate.

2. A device according to claim 1, wherein said rib is positioned above the resilient plate.

3. A device according to claim 1, wherein said stopper is formed of a material selected from a group consisting of sponge, rubber, polyurethane, and polyethylene.

4. A device according to claim 1, wherein said stopper is secured to an inner sidewall of said developing device through a rib projected from said inner sidewall and located near said resilient plate, said stopper being inserted between said rib and said resilient plate.

* * * * *